US011120721B2

(12) United States Patent
Zhao

(10) Patent No.: US 11,120,721 B2
(45) Date of Patent: Sep. 14, 2021

(54) DRIVER DEVICE AND DRIVING METHOD FOR DISPLAY PANEL

(71) Applicants: HKC Corporation Limited, Shenzhen (CN); Chongqing HKC Optoelectronics Technology Co., Ltd., Chongqing (CN)

(72) Inventor: Wenqin Zhao, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/650,261

(22) PCT Filed: Jul. 20, 2018

(86) PCT No.: PCT/CN2018/096436
§ 371 (c)(1),
(2) Date: Mar. 24, 2020

(87) PCT Pub. No.: WO2019/062294
PCT Pub. Date: Apr. 4, 2019

(65) Prior Publication Data

US 2021/0209985 A1 Jul. 8, 2021

(30) Foreign Application Priority Data

Sep. 28, 2017 (CN) ..... 20171089381939.9

(51) Int. Cl.
*G09G 3/20* (2006.01)

(52) U.S. Cl.
CPC ..... *G09G 3/20* (2013.01); *G09G 2300/08* (2013.01); *G09G 2310/0254* (2013.01); *G09G 2310/0275* (2013.01); *G09G 2310/0291* (2013.01)

(58) Field of Classification Search
CPC ..... G09G 2310/0291; G09G 3/3614; G09G 2310/0297; G09G 2310/0254
See application file for complete search history.

(56) References Cited

U.S. PATENT DOCUMENTS

2005/0206629 A1* 9/2005 Tseng ..... G09G 3/3688 345/204
2011/0298769 A1* 12/2011 Cho ..... G09G 3/3688 345/209
2012/0127144 A1* 5/2012 Sun ..... G09G 3/3688 345/209

(Continued)

FOREIGN PATENT DOCUMENTS

CN 105630055 A 6/2016

*Primary Examiner* — Gerald Johnson
(74) *Attorney, Agent, or Firm* — Wang Law Firm, Inc.

(57) ABSTRACT

The present disclosure illustrates a driver device and a driving method for a display panel. The driver device includes a source driver module, M positive output buffer modules, a positive input selection module, a positive output selection module, N negative output buffer modules, a negative input selection module and a negative output selection module. The driver device selects, according to the drive polarity and magnitude of the inputted drive signal, the corresponding positive output buffer module or negative output buffer module for data buffering of the display panel.

18 Claims, 6 Drawing Sheets

(56) References Cited

U.S. PATENT DOCUMENTS

| | | | | |
|---|---|---|---|---|
| 2015/0228234 | A1* | 8/2015 | Lin | G09G 3/3614<br>345/212 |
| 2017/0140695 | A1* | 5/2017 | Guo | G09G 3/2092 |
| 2018/0254012 | A1* | 9/2018 | Lin | G09G 3/3685 |
| 2019/0073075 | A1* | 3/2019 | Cho | G09G 3/3674 |

* cited by examiner

DRIVER DEVICE AND DRIVING METHOD FOR DISPLAY PANEL

CROSS-REFERENCE TO RELATED APPLICATION

This application claims priority to China Patent Application No. 201710893819.9 filed on Sep. 28, 2017, and entitled "Drive device and drive method for display panel" at State Intellectual Property Office of the P.R.C, the entirety of which is hereby incorporated by reference.

BACKGROUND

1. Field

The present disclosure relates to a display technology field, more particularly to a driver device and a driving method for a display panel.

2. Description of the Related Art

With continuous development of display technology, the development trend of display devices such as LCD panel and LCD display, is towards compactness, large size, low power consumption and low cost, However, when a size of the display panel of the display device becomes larger, a source driver IC for driving the display panel has to output a drive voltage having higher frequency, and it causes that the source driver IC has higher power consumption and generates more heat, and lifetime thereof is reduced.

SUMMARY

An objective of the present disclosure is to provide a driver device and a driving method for a display panel, to solve above-mentioned problems.

According to an embodiment, the present disclosure provides a driver device including: a source driver module configured to output a first polarity drive signal and a second polarity drive signal to drive the display panel; M positive output buffer modules, wherein an upper limit of an operation voltage range of a 1st positive output buffer module is a maximum drive voltage inputted into the driver device, a lower limit of an operation voltage range of a Mth positive output buffer module is a half of the maximum drive voltage, a lower limit value of an operation voltage range of an ith positive output buffer module is equal to an upper limit value of an operation voltage range of an (i+1)th positive output buffer module, wherein $M>i\geq 1$, and M and i are positive integers; a positive input selection module electrically connected to the source driver module and the M positive output buffer modules, and configured to select, according to the first polarity drive signal, one of the M positive output buffer modules as a targeted positive output buffer module, wherein an operation voltage range of the targeted positive output buffer module corresponds to the first polarity drive signal, and targeted positive output buffer module is configured to buffer the first polarity drive signal; a positive output selection module electrically connected to the M positive output buffer modules and the display panel; N negative output buffer modules, wherein an upper limit value of an operation voltage range of a 1st negative output buffer module is a half of the maximum drive voltage, a lower limit value of an operation voltage range of a Nth negative output buffer module is zero, a lower limit value of an operation voltage range of a jth negative output buffer module is equal to an upper limit value of an operation voltage range of a (j+1)th negative output buffer module, wherein $N>j\geq 1$, and N and j are positive integers; a negative input selection module electrically connected to the source driver module and the N negative output buffer modules, and configured to select, according to the second polarity drive signal, one of the N negative output buffer modules as a targeted the negative output buffer module, wherein an operation voltage range of the targeted the negative output buffer module corresponds to the second polarity drive signal, and a negative output selection module electrically connected to the N negative output buffer modules and the display panel, and configured to select the targeted negative output buffer module to output the buffered second polarity drive signal to the display panel.

Preferably, M is not equal to N.

Preferably, M and N both are equal to 2, and the M positive output buffer modules includes a first positive output buffer module electrically connected to the positive input selection module and the positive output selection module, and configured to receive the maximum drive voltage and a first drive voltage; a second positive output buffer module electrically connected to the positive input selection module and the positive output selection module, and configured to receive the first drive voltage and a second drive voltage; wherein the N negative output buffer modules comprise: a first the negative output buffer module electrically connected to the negative input selection module and the negative output selection module, and configured to receive the second drive voltage and a third drive voltage; and a second negative output buffer module electrically connected to the negative input selection module and the negative output selection module, and configured to receive the third drive voltage and ground voltage.

Preferably, the positive output buffer module comprises a first output buffer unit and the negative output buffer module comprises a second output buffer unit.

Preferably, the positive input selection module comprises a first electronic switch unit, the positive output selection module comprises a second electronic switch unit, the negative input selection module comprises a third electronic switch unit, and the negative output selection module comprises a fourth electronic switch unit.

According to an embodiment, the present disclosure provides a driving method for a display panel, and the driving method includes following steps of: when a first polarity drive signal is inputted, selecting a positive output buffer module having an operation voltage range corresponding to a first polarity drive signal, as a targeted positive output buffer module, and buffering the first polarity drive signal by the targeted positive output buffer module; outputting the buffered first polarity drive signal to the display panel; when a second polarity drive signal is inputted, selecting a negative output buffer module having an operation voltage range corresponding to a second polarity drive signal, as a targeted the negative output buffer module, and buffering the second polarity drive signal by the targeted positive output buffer module; and outputting the buffered the second polarity drive signal to the display panel.

According to an embodiment, the present disclosure provides a driving method for a display panel, and the driving method includes the following steps of: when a first polarity drive signal is inputted, selecting one of M positive output buffer modules as a targeted the positive output buffer module, wherein the operation voltage range of the targeted the positive output buffer module corresponds to the first polarity drive signal; buffering the first polarity drive signal by the targeted positive output buffer module; outputting the buffered the first polarity drive signal to the display panel; when a second polarity drive signal is inputted, selecting one of N negative output buffer modules as a targeted the negative output buffer module, wherein the operation voltage range of the targeted the negative output buffer module corresponds to the second polarity drive signal; buffering the second polarity drive signal by the targeted positive output buffer module; outputting the buffered the second polarity drive signal to the display panel. An upper limit value of an operation voltage range of a 1st positive output buffer module is a maximum drive voltage inputted into a driver device electrically connected to the display panel, a lower limit of an operation voltage range of a Mth positive output buffer module is a half of the maximum drive voltage, a lower limit value of an operation voltage range of an ith positive output buffer module is equal to an upper limit value of an operation voltage range of an (i+1)th positive output buffer module, wherein $M>i\geq 1$, and M and i are positive integers. An upper limit value of an operation voltage range of a 1st negative output buffer module is a half of the maximum drive voltage, a lower limit value of an operation voltage range of an Nth negative output buffer module is zero, a lower limit value of an operation voltage range of a jth negative output buffer module is equal to an upper limit value of an operation voltage range of a (j+1)th negative output buffer module, wherein $N>j\geq 1$, and N and j are positive integers.

Preferably, M is not equal to N.

According to above-mentioned content, the driver device and the driving method for the display panel can select, according to the drive polarity and magnitude of the inputted drive signal, the corresponding positive output buffer module or negative output buffer module for data buffering of the display panel, so as to effectively lower the frequency of the drive voltage outputted from the source driver IC, reduce power consumption of the source driver chip, thereby solving heat dissipation problem and increasing lifetime.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
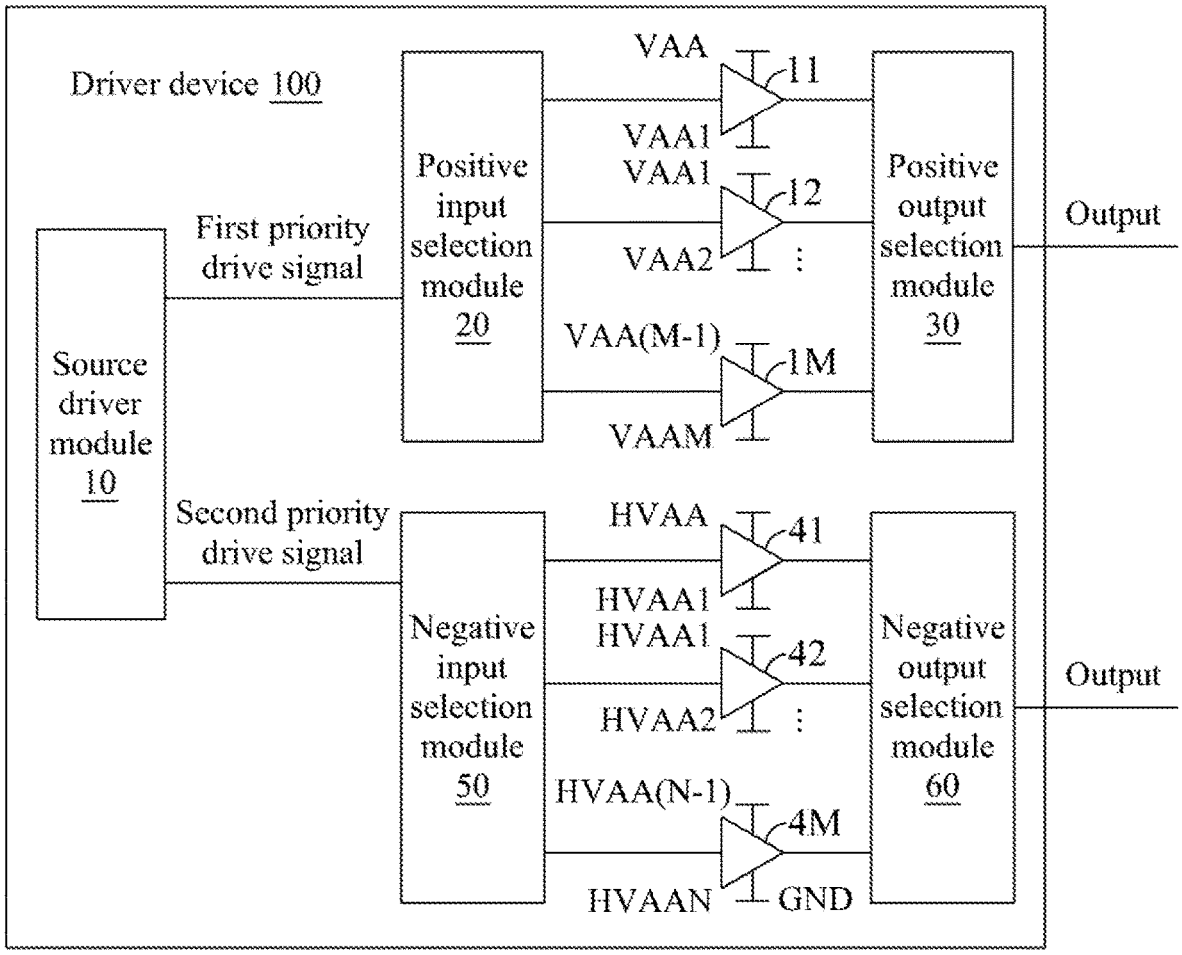
FIG. 1 is a schematic structural view of a driver device of a display panel of an embodiment of the present disclosure.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

Please refer to FIG. 1. In an embodiment of the present disclosure, a driver device 100 includes a source driver module 10, M positive output buffer modules, a positive input selection module 20, a positive output selection module 30, N negative output buffer modules, a negative input selection module 50 and a negative output selection module 60.

In specific application, the source driver module 10 can be any component or circuit having data drive function for pixels of the display panel, for example, source driver IC or source-chip on film (S-COF).

In specific application, a number of the positive output buffer modules can be determined upon practice demand; for example, the driver device can include two positive output buffer modules to divide the first polarity drive signal outputted from the source driver IC into two equal parts or to include three positive output buffer modules to divide the first polarity drive signal outputted from the source driver IC into three equal parts.

FIG. 1 shows the M positive output buffer modules including a positive output buffer module 11, a positive output buffer module 12, . . . and a positive output buffer module 1M; wherein, an upper limit of an operation voltage range of the 1st positive output buffer module is a maximum drive voltage inputted into the driver device, a lower limit of an operation voltage range of the Mth positive output buffer module is a half of the maximum drive voltage, a lower limit value of an operation voltage range of ith positive output buffer module 1*i* is equal to an upper limit value of an operation voltage range of the (i+1)th positive output buffer module 1*i*+1, $M>i\geq 1$, and M and i are positive integers.

As shown in FIG. 1, the upper limit value and the lower limit value of the operation voltage range of the 1st positive output buffer module 11 are VAA and VAA1, respectively; the upper limit value and the lower limit value of the operation voltage range of a 2nd positive output buffer module 12 are VAA1 and VAA2, respectively; . . . and the upper limit value and the lower limit value of the operation voltage range of the Mth positive output buffer module 1M are VAA(M−1) and VAAM, respectively, and VAAM is equal to a half of VAA.

In specific application, the positive output buffer module includes a first output buffer unit, and the first output buffer unit can be any component or circuit having output buffer function, for example, output buffer.

In specific application, sizes of the operation voltage ranges of the adjacent positive output buffer modules can be the same or different, the size of the operation voltage range means a difference between the upper limit value and the lower limit value of the operation voltage range. The 1st positive output buffer module is taken as example, and the size of the operation voltage of the 1st positive output buffer module is (VAA-VAA1).

The positive input selection module 20 is electrically connected to the source driver module 10 and the M positive output buffer modules 11~1M, and configured to select, according to the first polarity drive signal, one of the M the positive output buffer modules as a targeted the positive output buffer module, and the operation voltage range of the targeted the positive output buffer module corresponds to the first polarity drive signal. The targeted the positive output buffer module is configured to buffer the first polarity drive signal.

In specific application, the positive input selection module includes a first electronic switch unit, and the first electronic switch unit can be any component or circuit having electronic switch function, for example, transistor or metal oxide semiconductor (MOS) field effect transistor.

The positive output selection module 30 is electrically connected to the M positive output buffer modules 11~1M and the display panel 200, and configured to select the targeted positive output buffer module to output the buffered first polarity drive signal to the display panel 200.

In specific application, the positive output selection module includes a second electronic switch unit, and the second electronic switch unit can be any component or circuit having electronic switch function, for example, transistor or metal oxide semiconductor (MOS) field effect transistor.

In specific application, a number of the negative output buffer modules can be determined upon practice demand; for example, the driver device can include two negative output buffer modules to divide the second polarity drive signal outputted from the source driver IC into two equal parts; or, the driver device can include three the negative output buffer modules to divide the second polarity drive signal outputted from the source driver IC into three equal parts.

In this embodiment shown in FIG. 1, the drive device can include N negative output buffer modules including a negative output buffer module 41, a negative output buffer module 42, . . . a negative output buffer module 4N. The upper limit value of the operation voltage range of the 1st the negative output buffer module 41 is a half of the maximum drive voltage, the lower limit value of the operation voltage range of the Nth negative output buffer module 4N is zero, the lower limit value of the operation voltage range of the jth negative output buffer module 4*j* is equal to the upper limit value of the operation voltage range of the (j+1)th negative output buffer module 4*j*+1, and N>j≥1, and N and j are positive integers;

As shown in FIG. 1, the upper limit value and the lower limit value of the operation voltage range of the 1st negative output buffer module 41 are HVAA and HVAA1, respectively; the upper limit value and the lower limit value of the operation voltage range of the 2nd negative output buffer module 42 are HVAA1 and HVAA2, respectively; . . . , and the upper limit value and the lower limit value of the operation voltage range of the Nth negative output buffer module 4N are HVAA(N−1) and HVAAN, respectively, and HVAA=VAAM=1/2VAA, HVAAN=0.

In specific application, when the operation voltage is equal to 0, it is equivalent to connect ground. As shown in FIG. 1, in the Nth negative output buffer module, the terminal on which the operation voltage is 0 is connected to ground GND.

In specific application, the negative output buffer module includes a second output buffer unit, and the second output buffer unit can be any component or circuit having output buffer function, for example, an output buffer.

In specific application, sizes of the operation voltage ranges of the adjacent the negative output buffer modules can be the same or different, the size of the operation voltage range means a difference between the upper limit value and the lower limit value of the operation voltage range. The 1st negative output buffer module is taken as example, the size of the operation voltage range of the 1st negative output buffer module is (HVAA-HVAA1).

The negative input selection module 50 is electrically connected to the source driver module 10 and N output buffer modules 41~4N, and configured to selecting, according to the second polarity drive signal, one of the second output buffer modules as the targeted negative output buffer module, and the selected second output buffer module has an operation voltage range corresponding to the second polarity drive signal. The targeted negative output buffer module is configured to buffer the second polarity drive signal.

In specific application, the negative input selection module can include a third electronic switch unit, and the third electronic switch unit can be any component or circuit having electronic switch function, for example, transistor or metal oxide semiconductor (MOS) field effect transistor.

The negative output selection module 60 is electrically connected to the N output buffer modules 41-4N and the display panel 200, and configured to select one of the second output buffer modules corresponding to the second polarity drive signal, to output the buffered second polarity drive signal to the display panel 200.

In specific application, the negative output selection module can include a fourth electronic switch unit, and the fourth electronic switch unit can be any component or circuit having electronic switch function, for example, transistor or metal oxide semiconductor (MOS) field effect transistor.

In specific application, the values of M and N can be set according to actual requirement, and the number of the divided operation voltage ranges is directly determined by the values of M and N, so as to determine the frequency of the drive voltage outputted from the source driver IC. When the values of M and N are higher, the frequency of the drive voltage outputted from the source driver IC is lower. Preferably, M can be equal to N, and can be non-equal to N.

The this embodiment provides a driver device of a display panel, and the deriver device can select, according to the drive polarity and magnitude of the inputted drive signal, the corresponding positive output buffer module or negative output buffer module for data buffering of the display panel, so as to effectively lower the frequency of the drive voltage outputted from the source driver IC, reduce power consumption of the source driver chip, thereby solving heat dissipation problem and increasing lifetime.

Figure 2:
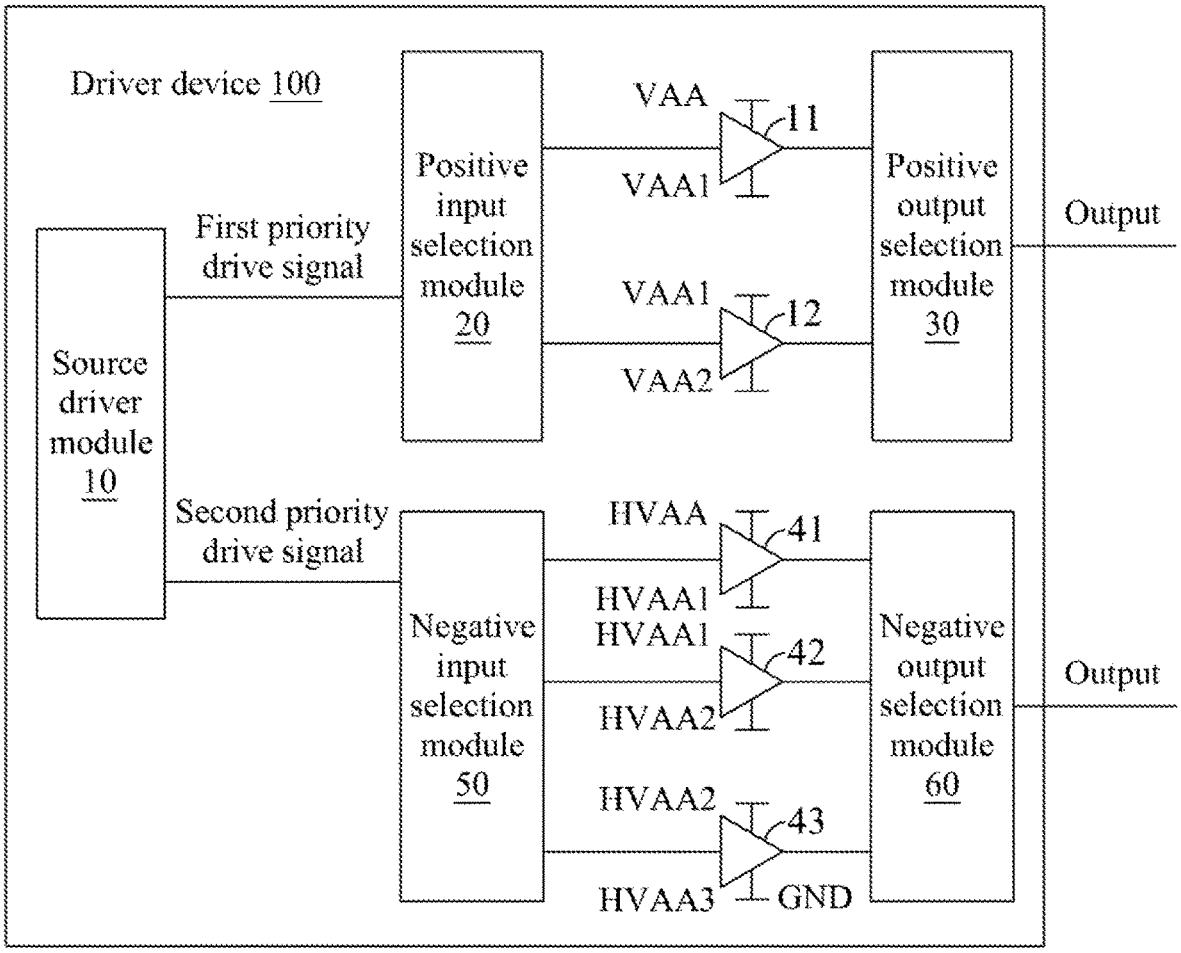
FIG. 2 is a schematic structural view of a driver device of a display panel of other embodiment of the present disclosure.

As shown in FIG. 2, in an embodiment of the present disclosure, M is not equal to N; for example, M=2, N=3, and the driver device 100 includes the first positive output buffer module 11, the second positive output buffer module 12, the first negative output buffer module 41, the second negative output buffer module 42 and the third negative output buffer module 43.

The first positive output buffer module 11 is electrically connected to the positive input selection module 20 and the positive output selection module 30, and configured to receive a maximum drive voltage and a first positive drive voltage VAA1, and buffer the first polarity drive signal when the first polarity drive signal is inputted.

In an embodiment, the first drive voltage is equal to three fourth of the maximum drive voltage.

The second positive output buffer module 12 is electrically connected to the positive input selection module 20 and the positive output selection module 30, and configured to receive a first positive drive voltage VAA1 and a second positive drive voltage VAA2, and buffer the first polarity drive signal when the first polarity drive signal is inputted.

In an embodiment, the second positive drive voltage is equal to a half of the maximum drive voltage.

The first negative output buffer module 41 is electrically connected to the negative input selection module 50 and the negative output selection module 60, and configured to receive a first negative drive voltage HVAA and a second negative drive voltage HVAA1, and buffer the second polarity drive signal when the second polarity drive signal is inputted. The first negative drive voltage is equal to the second positive drive voltage, that is, HVAA=VAA2=1/2 VAA.

In an embodiment, the second negative drive voltage is equal to one third of maximum drive voltage.

The second negative output buffer module 42 is electrically connected to the negative input selection module 50 and the negative output selection module 60, and configured to receive the second negative drive voltage HVAA1 and the third negative drive voltage HVAA2, and buffer the second polarity drive signal when the second polarity drive signal is inputted.

In an embodiment, HVAA2 is equal to one sixth of VAA.

The third negative output buffer module 43 is electrically connected to the negative input selection module 50 and the negative output selection module 60, and configured to receive the third negative drive voltage HVAA2 and ground voltage from ground GND (that is, the voltage HVAA3), and buffer the second polarity drive signal when the second polarity drive signal is inputted.

Figure 3:
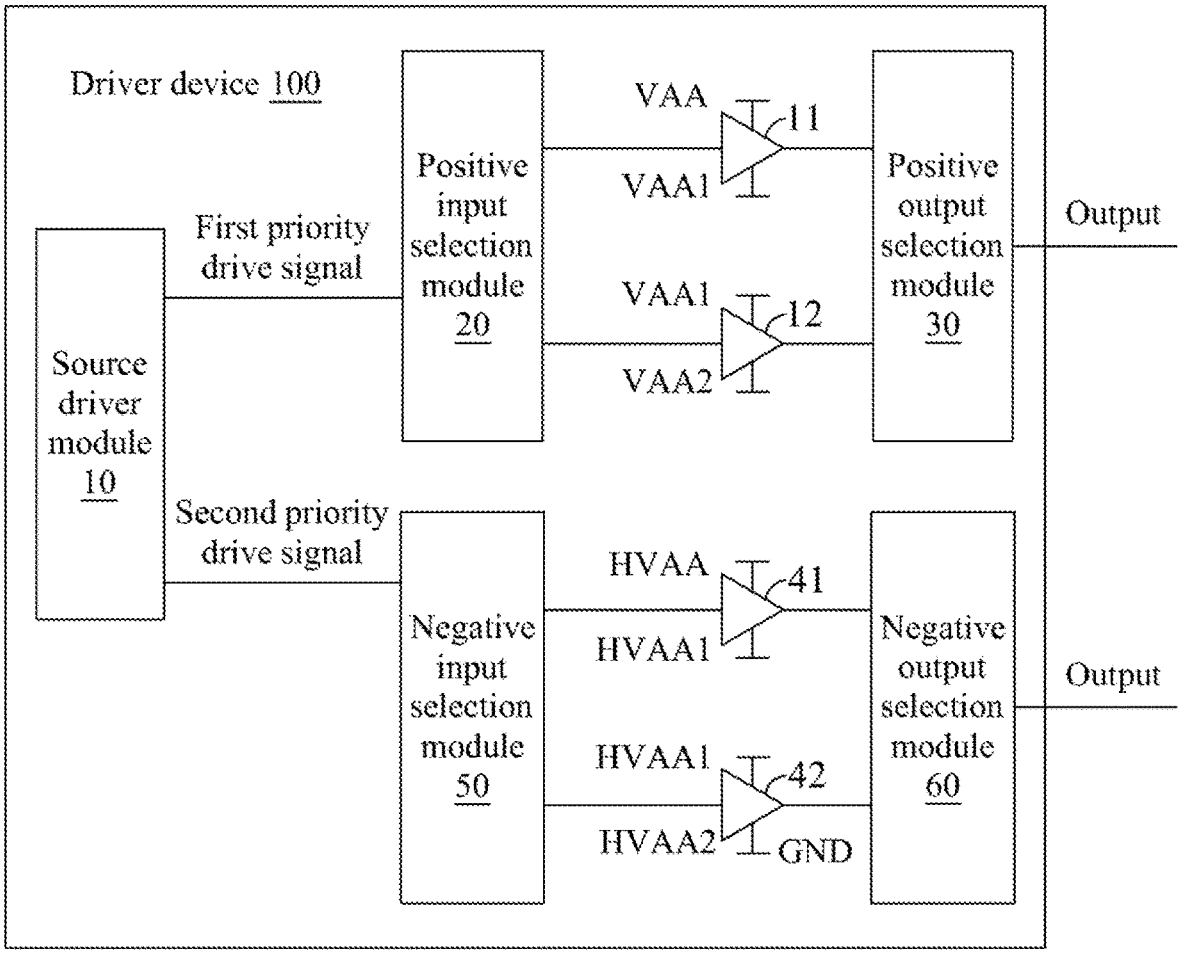
FIG. 3 is a schematic structural view of a driver device of a display panel of another embodiment of the present disclosure.

As shown in FIG. 3, in an embodiment of the present disclosure, M and N both are equal to 2, and the sizes of the adjacent voltage ranges are the same. The driver device 100 includes the first positive output buffer module 11, the second positive output buffer module 12, the first negative output buffer module 41 and the second negative output buffer module 42.

The first positive output buffer module 11 is electrically connected to the positive input selection module 20 and the positive output selection module 30, and configured to receive the maximum drive voltage and a first positive drive voltage VAA1, and configured to buffer the first polarity drive signal when the first polarity drive signal is inputted.

In an embodiment, the first positive drive voltage is equal to three fourth of the maximum drive voltage.

The second positive output buffer module 12 is electrically connected to the positive input selection module 20 and the positive output selection module 30, and configured to receive a first positive drive voltage VAA1 and a second positive drive voltage VAA2, and configured to buffer the first polarity drive signal when the first polarity drive signal is inputted.

In an embodiment, the second positive drive voltage is equal to a half of the maximum drive voltage.

The first the negative output buffer module 41 I electrically connected to the negative input selection module 50 and the negative output selection module 60, and configured to receive a first negative drive voltage HVAA and a second negative drive voltage HVAA1, and, buffer the second polarity drive signal when the second polarity drive signal is inputted. The first negative drive voltage is equal to the second positive drive voltage, that is, HVAA=VAA2=1/2 VAA.

In an embodiment, the second negative drive voltage is equal to one fourth of the maximum drive voltage.

The second negative output buffer module 42 is electrically connected to the negative input selection module 50 and the negative output selection module 60, and configured to receive the second negative drive voltage HVAA1 and ground voltage from ground GND (that is, the voltage HVAA2), and buffer the second polarity drive signal when the second polarity drive signal is inputted.

It will be further understood that the positive drive voltage and the negative drive voltage of the embodiment are a relatively-higher voltage and a relatively-lower voltage, respectively, but not the voltages with positive polarity or negative polarity. The value of the positive drive voltage is higher than or equal to that of the negative drive voltage.

In an embodiment, the driver device further includes a digital-to-analog conversion module electrically connected to the positive input selection module and the negative input selection module, and configured to receive and convert the first polarity drive data and the second polarity drive data into the first polarity drive signal and the second polarity drive signal.

In an embodiment, the digital-to-analog conversion module can be a digital-to-analog convertor configured to convert a digital signal to an analog signal, In an embodiment, the driver device further includes a shift register module, a data register module, a data latch module and a level shift module.

The shift register module is configured to output drive data according to a given shift direction.

The data register module is electrically connected to the shift register module, and configured to store the drive data.

The data latch module is electrically connected to the data register module, configured to latch the drive data, and output the first polarity drive data when receiving the first polarity drive signal, and output the second polarity drive data when receiving the second polarity drive signal.

The level shift module is electrically connected to the data latch module and the digital-to-analog conversion module, and configured to level shift the first polarity drive data and the second polarity drive data, and output the level-shifted first polarity drive data and second polarity drive data to the digital-to-analog conversion module.

In specific application, the shift register module can be a unidirectional shift register or a bi-directional shift register, the data register module can be a data register, and the data latch module can be a data latch, and the level shift module can be a level shift circuit.

In an embodiment, the driver device further includes a control module electrically connected to the source driver module, the positive input selection module, the positive output selection module, the negative input selection module and the negative output selection module. The control module is configured to control working states of the modules connected thereto.

In an embodiment, the display panel can be any type of display panel, such as liquid crystal display panel, organic electroluminescence display panel, Q LED panel, or curved display panel.

Figure 4:
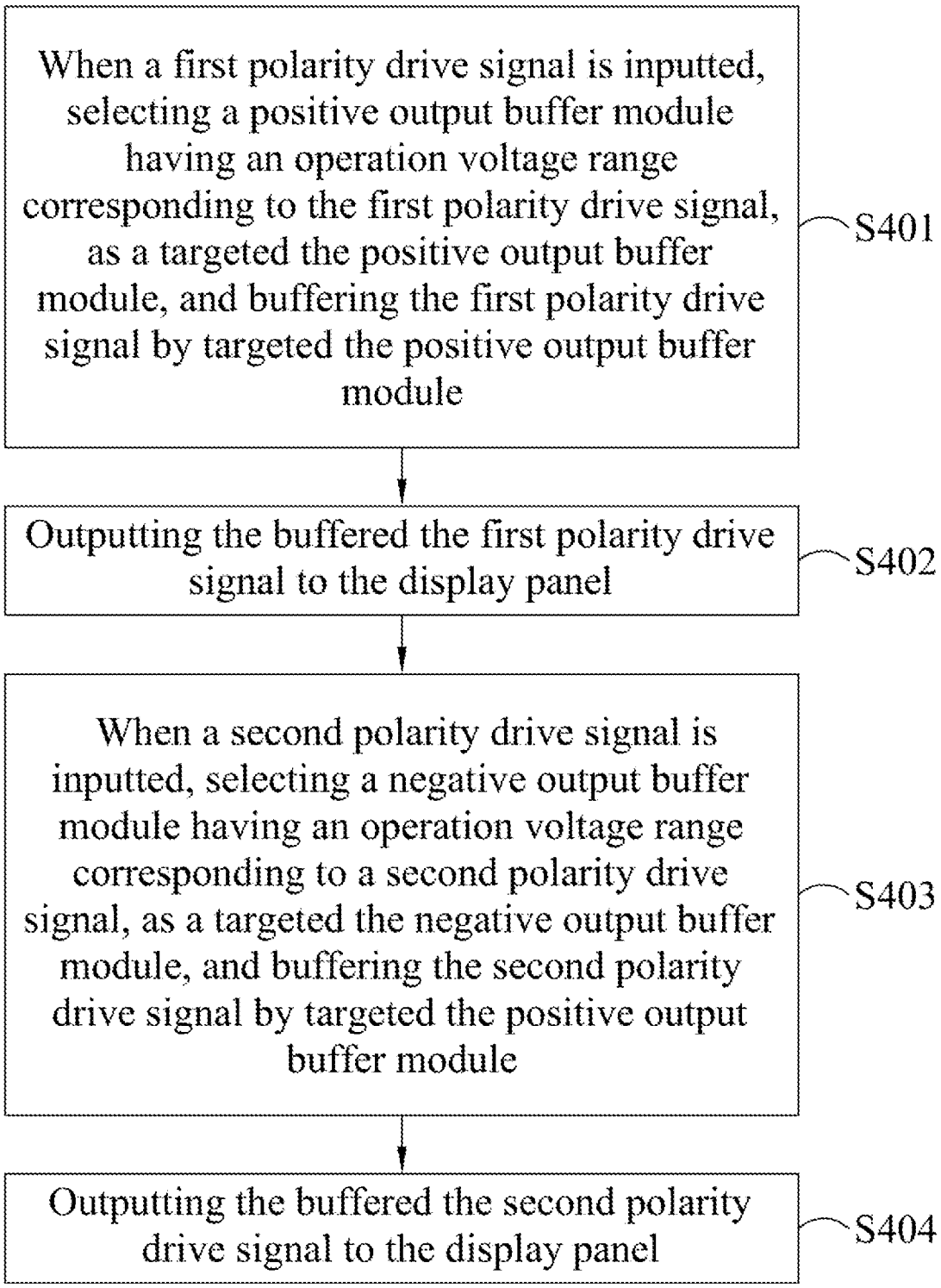
FIG. 4 is a flow chart of a driving method for a display panel of an embodiment of the present disclosure.

Please refer to FIG. 4. An embodiment of the present disclosure provides a driving method for a display panel, and the driving method includes following steps S401 through S404.

The step S401 is a step of, when a first polarity drive signal is inputted, selecting a positive output buffer module having an operation voltage range corresponding to the first polarity drive signal, as a targeted the positive output buffer module, and buffering the first polarity drive signal by targeted the positive output buffer module.

The step S402 is a step of outputting the buffered the first polarity drive signal to the display panel.

The step S403 is a step of, when a second polarity drive signal is inputted, selecting a negative output buffer module having an operation voltage range corresponding to a second polarity drive signal, as a targeted the negative output buffer module, and buffering the second polarity drive signal by targeted the positive output buffer module.

The step S404 is a step of outputting the buffered the second polarity drive signal to the display panel.

In specific application, the driving method for this embodiment can be implemented by the driver device of any one of aforementioned embodiments, wherein, the steps S401-S404 can be executed by the positive input selection module, the positive output selection module, the negative input selection module and the negative output selection module.

Figure 5:
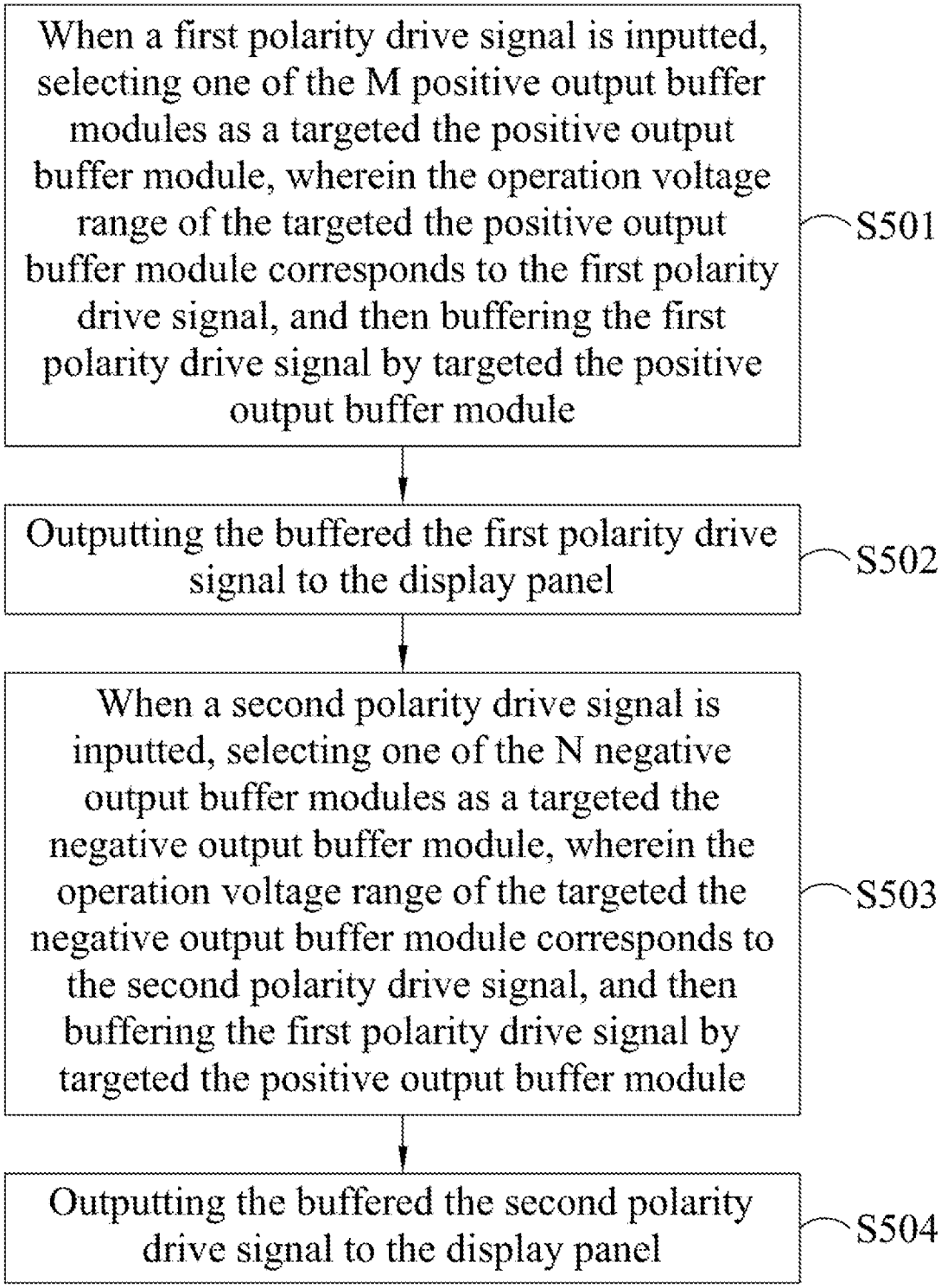
FIG. 5 is a flow chart of a driving method for a display panel of other embodiment of the present disclosure.

Please refer to FIG. 5. An embodiment of the present disclosure provides a driving method for a display panel, and the driving method includes following steps S501 through S504.

The step S501 is a step of, when a first polarity drive signal is inputted, selecting one of the M positive output buffer modules as a targeted the positive output buffer module, wherein the operation voltage range of the targeted the positive output buffer module corresponds to the first polarity drive signal, and then buffering the first polarity drive signal by targeted the positive output buffer module.

The step S502 is a step of outputting the buffered the first polarity drive signal to the display panel.

The step S503 is a step of, when a second polarity drive signal is inputted, selecting one of the N negative output buffer modules as a targeted the negative output buffer module, wherein the operation voltage range of the targeted the negative output buffer module corresponds to the second polarity drive signal, and then buffering the first polarity drive signal by targeted the positive output buffer module.

The step S504 is a step of outputting the buffered the second polarity drive signal to the display panel.

The upper limit value of the operation voltage range of the 1st positive output buffer module is the maximum drive voltage inputted into the driver device electrically connected to the display panel, the lower limit of an operation voltage range of the Mth positive output buffer module is a half of the maximum drive voltage, the lower limit value of the operation voltage range of the ith positive output buffer module is equal to the upper limit value of the operation voltage range of the (i+1)th positive output buffer module, and $M>i\geq 1$, and M and i are positive integers. The upper limit value of the operation voltage range of the 1st the negative output buffer module is a half of the maximum drive voltage, the lower limit value of the operation voltage range of the Nth negative output buffer module is zero, the lower limit value of the operation voltage range of the jth negative output buffer module is equal to the upper limit value of the operation voltage range of the (j+1)th the negative output buffer module, $N>j\geq 1$, and N and j are positive integers.

In specific application, the driving method provided by this embodiment can be implemented by the driver device of any one of aforementioned embodiments, for example, the steps S501 through S504 can be executed by the positive input selection module, the positive output selection module, the negative input selection module and the negative output selection module.

The modules of all embodiments of the present disclosure can be implemented by central processing unit (CPU), application specific integrated circuit (ASIC), or field-programmable gate array (FPGA).

Figure 6:
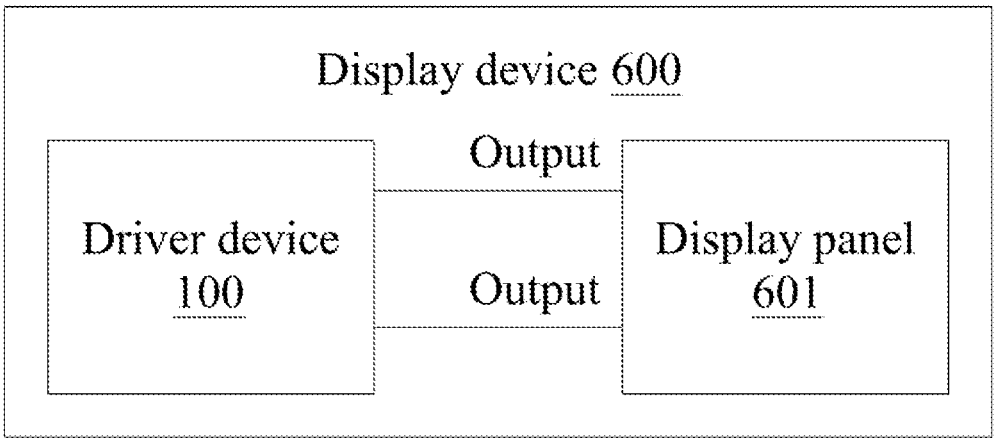
FIG. 6 is a schematic structural view of a display device of an embodiment of the present disclosure.

Please refer to FIG. 6. An embodiment of the present disclosure provides a display device 600, and the display device 600 includes the driver device 100 and the display panel 601 electrically connected to the output terminal of the driver device 100.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A driver device of a display panel, comprising:

a source driver module configured to output a first polarity drive signal and a second polarity drive signal to drive the display panel;

M positive output buffer modules, wherein an upper limit of an operation voltage range of a 1st positive output buffer module is a maximum drive voltage inputted into the driver device, a lower limit of an operation voltage range of a Mth positive output buffer module is a half of the maximum drive voltage, a lower limit value of an operation voltage range of an ith positive output buffer module is equal to an upper limit value of an operation voltage range of an (i+1)th positive output buffer module, wherein $M>i\geq 1$, and M and i are positive integers;

a positive input selection module electrically connected to the source driver module and the M positive output buffer modules, and configured to select, according to the first polarity drive signal, one of the M positive output buffer modules as a targeted positive output buffer module, wherein an operation voltage range of the targeted positive output buffer module corresponds to the first polarity drive signal, and targeted positive output buffer module is configured to buffer the first polarity drive signal;

a positive output selection module electrically connected to the M positive output buffer modules and the display panel;

N negative output buffer modules, wherein an upper limit value of an operation voltage range of a 1st negative output buffer module is a half of the maximum drive voltage, a lower limit value of an operation voltage range of a Nth negative output buffer module is zero, a lower limit value of an operation voltage range of a jth negative output buffer module is equal to an upper limit value of an operation voltage range of a (j+1)th negative output buffer module, wherein $N>j\geq 1$, and N and j are positive integers;

a negative input selection module electrically connected to the source driver module and the N negative output buffer modules, and configured to select, according to the second polarity drive signal, one of the N negative output buffer modules as a targeted the negative output buffer module, wherein an operation voltage range of the targeted the negative output buffer module corresponds to the second polarity drive signal; and a negative output selection module electrically connected to the N negative output buffer modules and the display panel, and configured to select the targeted negative output buffer module to output the buffered second polarity drive signal to the display panel.

2. The driver device according to claim 1, wherein M is not equal to N.

3. The driver device according to claim 2, wherein the positive output buffer module comprises a first output buffer unit and the negative output buffer module comprises a second output buffer unit.

4. The driver device according to claim 2, wherein the positive input selection module comprises a first electronic switch unit, the positive output selection module comprises a second electronic switch unit, the negative input selection module comprises a third electronic switch unit, and the negative output selection module comprises a fourth electronic switch unit.

5. The driver device according to claim 2, wherein M=2, N=3, and the M positive output buffer modules comprise:

a first positive output buffer module electrically connected to the positive input selection module and the positive output selection module, and configured to receive the maximum drive voltage and a first drive voltage; and a second positive output buffer module electrically connected to the positive input selection module and the positive output selection module, and configured to receive the first drive voltage and a second drive voltage;

wherein the N negative output buffer modules comprise:

a first negative output buffer module electrically connected to the negative input selection module and the negative output selection module, and configured to receive the second drive voltage and a third drive voltage;

a second negative output buffer module electrically connected to the negative input selection module and the negative output selection module, and configured to receive the third drive voltage and a fourth drive voltage; and a third negative output buffer module electrically connected to the negative input selection module and the negative output selection module, and configured to receive the fourth drive voltage and ground voltage.

6. The driver device according to claim 5, wherein the positive output buffer module comprises a first output buffer unit and the negative output buffer module comprises a second output buffer unit.

7. The driver device according to claim 5, wherein the positive input selection module comprises a first electronic switch unit, the positive output selection module comprises a second electronic switch unit, the negative input selection module comprises a third electronic switch unit, and the negative output selection module comprises a fourth electronic switch unit.

8. The driver device according to claim 1, wherein M=N.

9. The driver device according to claim 8, wherein the positive output buffer module comprises a first output buffer unit and the negative output buffer module comprises a second output buffer unit.

10. The driver device according to claim 8, wherein the positive input selection module comprises a first electronic switch unit, the positive output selection module comprises a second electronic switch unit, the negative input selection module comprises a third electronic switch unit, and the negative output selection module comprises a fourth electronic switch unit.

11. The driver device according to claim 8, wherein M and N both are equal to 2, and the M positive output buffer modules comprise:

a first positive output buffer module electrically connected to the positive input selection module and the positive output selection module, and configured to receive the maximum drive voltage and a first drive voltage; and a second positive output buffer module electrically connected to the positive input selection module and the positive output selection module, and configured to receive the first drive voltage and a second drive voltage;

wherein the N negative output buffer modules comprise:

a first the negative output buffer module electrically connected to the negative input selection module and the negative output selection module, and configured to receive the second drive voltage and a third drive voltage; and a second negative output buffer module electrically connected to the negative input selection module and the negative output selection module, and configured to receive the third drive voltage and ground voltage.

12. The driver device according to claim 11, wherein the positive output buffer module comprises a first output buffer unit and the negative output buffer module comprises a second output buffer unit.

13. The driver device according to claim 11, wherein the positive input selection module comprises a first electronic switch unit, the positive output selection module comprises a second electronic switch unit, the negative input selection module comprises a third electronic switch unit, and the negative output selection module comprises a fourth electronic switch unit.

14. The driver device according to claim 11, wherein the positive output buffer module comprises a first output buffer unit and the negative output buffer module comprises a second output buffer unit.

15. The driver device according to claim 11, wherein the positive input selection module comprises a first electronic switch unit, the positive output selection module comprises a second electronic switch unit, the negative input selection module comprises a third electronic switch unit, and the negative output selection module comprises a fourth electronic switch unit.

16. A driving method for a display panel, comprising:

when a first polarity drive signal is inputted, selecting a positive output buffer module having an operation voltage range corresponding to a first polarity drive signal, as a targeted positive output buffer module, and buffering the first polarity drive signal by the targeted positive output buffer module;

outputting the buffered first polarity drive signal to the display panel;

when a second polarity drive signal is inputted, selecting a negative output buffer module having an operation voltage range corresponding to a second polarity drive signal, as a targeted the negative output buffer module, and buffering the second polarity drive signal by the targeted positive output buffer module; and outputting the buffered the second polarity drive signal to the display panel.

17. A driving method for a display panel, comprising:

when a first polarity drive signal is inputted, selecting one of M positive output buffer modules as a targeted the positive output buffer module, wherein the operation voltage range of the targeted the positive output buffer module corresponds to the first polarity drive signal;

buffering the first polarity drive signal by the targeted positive output buffer module;

outputting the buffered the first polarity drive signal to the display panel;

when a second polarity drive signal is inputted, selecting one of N negative output buffer modules as a targeted the negative output buffer module, wherein the operation voltage range of the targeted the negative output buffer module corresponds to the second polarity drive signal; and buffering the second polarity drive signal by the targeted positive output buffer module;

outputting the buffered the second polarity drive signal to the display panel;

wherein an upper limit value of an operation voltage range of a 1st positive output buffer module is a maximum drive voltage inputted into a driver device electrically connected to the display panel, a lower limit of an operation voltage range of a Mth positive output buffer module is a half of the maximum drive voltage, a lower limit value of an operation voltage range of an ith positive output buffer module is equal to an upper limit value of an operation voltage range of an (i+1)th positive output buffer module, wherein $M>i\geq 1$, and M and i are positive integers;

wherein an upper limit value of an operation voltage range of a 1st negative output buffer module is a half of the maximum drive voltage, a lower limit value of an operation voltage range of an Nth negative output buffer module is zero, a lower limit value of an operation voltage range of a jth negative output buffer module is equal to an upper limit value of an operation voltage range of a (j+1)th negative output buffer module, wherein $N>j\geq 1$, and N and j are positive integers.

18. The driving method according to claim 17, wherein M is not equal to N.

* * * * *